US007670136B2

(12) United States Patent
Bishop

(10) Patent No.: US 7,670,136 B2
(45) Date of Patent: Mar. 2, 2010

(54) ARTIFICIAL ACETYLENE GAS CANDLE

(76) Inventor: James D. Bishop, 10629 Courtney Rd., Glen Allen, VA (US) 23060

( * ) Notice: Subject to any disclaimer, the term of this patent is extended or adjusted under 35 U.S.C. 154(b) by 122 days.

(21) Appl. No.: 11/947,846

(22) Filed: Nov. 30, 2007

(65) Prior Publication Data

US 2009/0142718 A1 Jun. 4, 2009

(51) Int. Cl.

| | |
|---|---|
| ***F23Q 2/32*** | (2006.01) |
| ***F21L 23/00*** | (2006.01) |
| ***F21L 19/00*** | (2006.01) |
| ***C10H 3/00*** | (2006.01) |

(52) U.S. Cl. ..... 431/125; 431/288; 362/160; 362/161; 48/25; 48/4

(58) Field of Classification Search ..... 431/289, 431/296, 253, 343, 125, 291, 288, 298, 344, 431/323; 362/160, 392, 810, 164, 165, 161; 48/25, 4

See application file for complete search history.

(56) References Cited

U.S. PATENT DOCUMENTS

| | | | | | |
|---|---|---|---|---|---|
| 638,153 | A | * | 11/1899 | Sunderland et al. | 48/25 |
| 714,318 | A | | 11/1902 | Moore | |
| 929,454 | A | * | 7/1909 | Loveless | 362/160 |
| 1,043,039 | A | | 10/1912 | Arnold | |
| 1,073,980 | A | * | 9/1913 | Gsohwendner | 362/160 |
| 1,228,772 | A | | 6/1917 | Hansemn | |
| 1,323,618 | A | * | 12/1919 | Chance | 362/164 |
| 1,420,133 | A | | 6/1922 | Neusiis | |
| 2,749,733 | A | * | 6/1956 | Smith et al. | 431/125 |
| 2,831,331 | A | * | 4/1958 | Rodman | 431/125 |
| 2,984,083 | A | | 5/1961 | Goddard et al. | |
| 3,066,516 | A | | 12/1962 | Falligant et al. | |
| 3,097,514 | A | * | 7/1963 | Stone | 431/125 |
| 3,165,909 | A | | 1/1965 | Green et al. | |
| 3,267,700 | A | * | 8/1966 | Kommer et al. | 431/21 |
| 3,326,021 | A | | 6/1967 | Latulippe | |
| 3,349,577 | A | | 10/1967 | Burchett et al. | |
| 3,360,967 | A | | 1/1968 | Massie | |
| 3,441,957 | A | * | 4/1969 | Friedman | 362/562 |
| 4,415,329 | A | * | 11/1983 | Dodd | 431/125 |
| 4,608,011 | A | * | 8/1986 | Comstock | 431/324 |
| 5,057,003 | A | * | 10/1991 | Yang | 431/125 |

* cited by examiner

*Primary Examiner*—Kenneth B Rinehart
*Assistant Examiner*—Daniel A Bernstein
(74) *Attorney, Agent, or Firm*—Thomas, Karceski, Raring & Teague, P.C.

(57) ABSTRACT

An improved artificial candle having an exterior appearance of a traditional wax candle, but which provides illumination by means of producing and burning acetylene gas.

15 Claims, 5 Drawing Sheets

ARTIFICIAL ACETYLENE GAS CANDLE

FIELD OF THE INVENTION

This invention relates to an artificial candle having an exterior appearance of a traditional wax candle, but which provides illumination by means of producing and burning acetylene gas.

BACKGROUND OF THE INVENTION

Providing scene illumination for films that are set in times that pre-date electrical lighting is difficult because electrical lights cannot appear on camera. For nighttime scenes, candles are often used—both as props and as scene lighting. However, typical wax candles are problematic for several reasons. Because wax candles burn down (i.e., become shorter as they burn), it is difficult to maintain continuity (i.e., a consistent candle height) over many different takes which may occur over many hours and days. Further, a standard wax candle may not emit a sufficient amount of light. Additionally, wax candles emit a light that is considered too yellow for scene lighting. It is known to use double-wick wax candles to increase the light output. However, double-wick candles burn down more quickly than single-wick candles, thus exacerbating the continuity problem. Double-wick candles also produce a great deal of smoke and soot.

Artificial, gas-burning candles may also be used in such films. However, known artificial candles are also problematic. Artificial candles fueled by butane emit light that appears too blue on film. Further, butane candles do not emit a consistent amount of light as the fuel supply decreases and the gas pressure therefore decreases.

Therefore it would be desirable to have an improved artificial candle capable of providing a sufficient, consistent light output

BRIEF SUMMARY OF THE INVENTION

The present invention overcomes the above-noted and other shortcomings of the prior art by providing a novel and improved artificial candle having an exterior appearance of a traditional wax candle, but which provides illumination by means of producing and burning acetylene gas.

In one embodiment, an artificial acetylene gas candle comprises first, second, third, fourth, and fifth cylinders. The first cylinder comprises a cylindrical wall, a closed bottom end, and an open top end, the cylindrical wall and the closed bottom end forming a fuel chamber adapted to contain calcium carbide fuel. The second cylinder comprises a cylindrical wall, an open bottom end, and a partially closed top end defining an aperture within the top end, the open bottom end adapted to slidingly engage the first cylinder. The inner diameter of the second cylinder is sized relative to an outer diameter of the first cylinder such that water is drawn by capillary action into a gap between the first and second cylinders and into the first cylinder when the first and second cylinders are at least partially immersed in water. The third cylinder comprises a cylindrical wall, a closed bottom end, and an open top end, and is adapted to receive water and to receive the slidingly-engaged first and second cylinders such that the first and second cylinders are at least partially immersed in water within the third cylinder. The fourth cylinder comprises a cylindrical wall, an open bottom end, and a partially closed top end defining an aperture within the top end. The fourth cylinder is sized to be received snugly by the second cylinder top end aperture. The fifth cylinder comprises a cylindrical wall, an open bottom end, and an open top end. The fifth is cylinder sized to be received snugly by the fourth cylinder top end aperture. Water drawn into the first cylinder contacts the calcium carbide fuel resulting in formation of acetylene gas, and the acetylene gas exits the artificial candle through the fourth and fifth cylinders to be ignited.

The artificial candle may further comprise a polymer clay skin surrounding the cylindrical wall of the third cylinder. The polymer clay skin may comprise a translucent polymer clay, and may have an uneven surface texture. Opposite sides of an upper end of the fifth cylinder may be partially compressed toward a longitudinal axis of the fifth cylinder.

In another embodiment, an artificial acetylene gas candle comprises first, second, third, and fourth cylinders. The first cylinder comprises a cylindrical wall, a closed bottom end, and an open top end, the cylindrical wall and the closed bottom end forming a fuel chamber adapted to contain calcium carbide fuel. The second cylinder comprises a cylindrical wall, an open bottom end, and a partially closed top end defining an aperture within the top end, the open bottom end adapted to slidingly engage the first cylinder. The inner diameter of the second cylinder is sized relative to an outer diameter of the first cylinder such that water is drawn by capillary action into a gap between the first and second cylinders and into the first cylinder when the first and second cylinders are at least partially immersed in water. The third cylinder comprises a cylindrical wall, a closed bottom end, and an open top end, and is adapted to receive water and to receive the slidingly-engaged first and second cylinders such that the first and second cylinders are at least partially immersed in water within the third cylinder. The fourth cylinder comprises a cylindrical wall, an open bottom end, and an open top end. The fourth cylinder sized to be received snugly by the second cylinder top end aperture. Water drawn into the first cylinder contacts the calcium carbide fuel resulting in formation of acetylene gas, and the acetylene gas exits the artificial candle through the fourth cylinder to be ignited.

The artificial candle may further comprise a polymer clay skin surrounding the cylindrical wall of the third cylinder. The polymer clay skin may comprise a translucent polymer clay, and may have an uneven surface texture. Opposite sides of an upper end of the fourth cylinder may be partially compressed toward a longitudinal axis of the fourth cylinder.

In another embodiment, an artificial acetylene gas candle comprises first, second, and third cylinders. The first cylinder comprises a cylindrical wall, a closed bottom end, and an open top end, the cylindrical wall and the closed bottom end forming a fuel chamber adapted to contain calcium carbide fuel. The second cylinder comprises a cylindrical wall, an open bottom end, and a partially closed top end defining an aperture within the top end, the top end tapered upwardly and inwardly from the cylindrical wall, the open bottom end adapted to slidingly engage the first cylinder. The inner diameter of the second cylinder is sized relative to an outer diameter of the first cylinder such that water is drawn by capillary action into a gap between the first and second cylinders and into the first cylinder when the first and second cylinders are at least partially immersed in water. The third cylinder comprises a cylindrical wall, a closed bottom end, and an open top end, and is adapted to receive water and to receive the slidingly-engaged first and second cylinders such that the first and second cylinders are at least partially immersed in water within the third cylinder. Water drawn into the first cylinder contacts the calcium carbide fuel resulting in formation of acetylene gas, and wherein the acetylene gas exits the artificial candle through the tapered top end of the second cylinder to be ignited.

The artificial candle may further comprise a polymer clay skin surrounding the cylindrical wall of the third cylinder. The polymer clay skin may comprise a translucent polymer clay, and may have an uneven surface texture. Opposite sides of an upper end of the tapered top end of the second cylinder may be partially compressed toward a longitudinal axis of the second cylinder.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
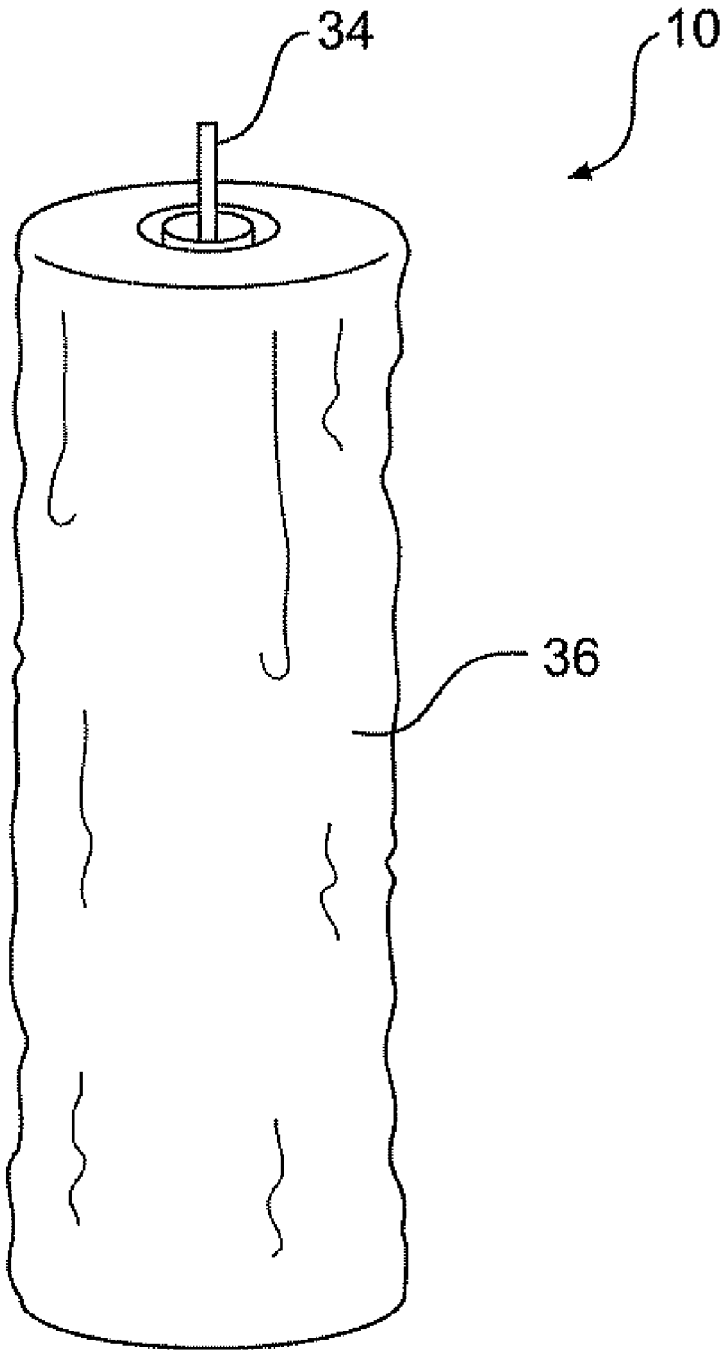
FIG. 1 is a perspective view of an artificial acetylene gas candle, in accordance with one embodiment of the present invention.

Referring now to FIG. 1, a perspective view of an artificial acetylene gas candle 10 is illustrated, in accordance with one embodiment of the present invention. As can be seen in FIG. 1, the artificial candle 10 closely resembles a standard wax candle. The artificial candle 10 has an upright, cylindrical shape with a wick-like structure 34 protruding from the top of the cylinder. The artificial candle 10 has an outer skin 36 that has an uneven surface appearance and comprises a material selected for its resemblance to candle wax. As can be seen in FIG. 1, the outer skin 36 may surround the circumference of the artificial candle and cover the top end.

Figure 2:
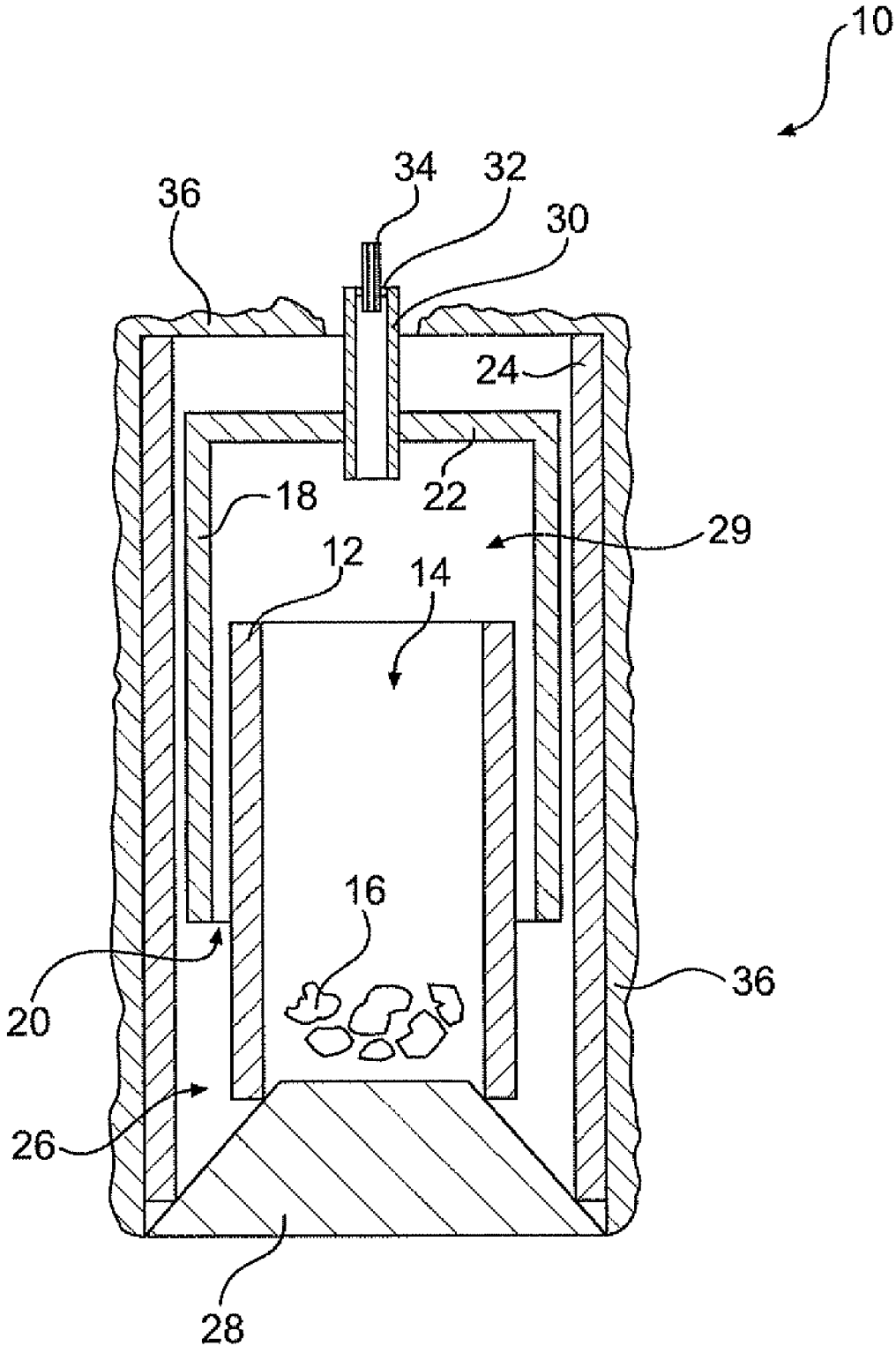
FIG. 2 is cross-sectional view of the artificial acetylene gas candle of FIG. 1, in accordance with one embodiment of the present invention.

Referring now to FIG. 2, cross-sectional view of the artificial candle of FIG. 1 is illustrated, in accordance with one embodiment of the present invention. The artificial candle 10 produces acetylene gas ($C_2H_2$), which is emitted through the wick-like structure and ignited. The acetylene gas is produced by the reaction of calcium carbide ($CaC_2$) with water (the structure for facilitating this reactions is described in more detail below). The burning acetylene gas produces a bright, broad-spectrum light which provides sufficient light for scene lighting and has a realistic candle-like light and appearance on camera.

The artificial candle 10 comprises a first cylinder 12, a second cylinder 18, a third cylinder 24, a fourth cylinder 30, a fifth cylinder 34, and a polymer clay skin 36. The first cylinder 12 comprises a cylindrical wall, a closed bottom end, and an open top end. The cylindrical wall and the closed bottom end form a fuel chamber 14 adapted to contain calcium carbide fuel 16. The calcium carbide fuel is typically in the form of small rocks or pellets. These carbide rocks may optionally be contained within a porous or mesh pouch or sock that sits in the fuel chamber. This pouch may be made of, for example, nylon, wool, or cotton fabric.

The second cylinder 18 comprises a cylindrical wall, an open bottom end, and a partially closed top end 22. The partially closed top end defines an aperture for snugly receiving the fourth cylinder 30. The open bottom end is adapted to slidingly engage the first cylinder, such that the second cylinder slides over the top of the first cylinder in a telescopic manner. The inner diameter of the second cylinder 18 is sized relative to the outer diameter of the first cylinder 12 such that water is drawn by capillary action into the gap 20 between the first and second cylinders and into the fuel chamber 14 of the first cylinder when the first and second cylinders are at least partially immersed in water. The water then contacts the calcium carbide fuel and produces acetylene gas. The size of the gap 20 affects the amount of water drawn into the fuel chamber, and thereby the amount of gas produced and the size of the flame. A looser fit between the first and second cylinders (i.e., a larger gap) results in an increased amount of water, a larger amount of gas produced, and a larger flame (assuming the gap is not so large that a capillary force cannot be created).

The third cylinder 24 comprises a cylindrical wall, a closed bottom end, and an open top end. The third cylinder is adapted to receive the slidingly-engaged first and second cylinders. As illustrated in FIG. 2, the bottom end of the first and third cylinders may be formed as a single unit, such as by a rubber stopper 28. Alternatively, the bottom ends of the first and third cylinders may be separately formed, such that the first cylinder is resting on the closed bottom end of the third cylinder when the third cylinder receives the slidingly-engaged first and second cylinders. The third cylinder is further adapted to receive water in the water chamber 26 formed between the cylindrical wall and the first and second cylinders. As such, the first and second cylinders are at least partially immersed in water within the third cylinder. As described above, this water is drawn by capillary force into the gap 20 and into the fuel chamber 14.

The fourth cylinder 30 comprises a cylindrical wall, an open bottom end, and a partially closed top end 32. The partially closed top end defines an aperture for snugly receiving the fifth cylinder 34. The fourth cylinder is sized to be received snugly by the top end aperture of the second cylinder.

The fifth cylinder comprises a cylindrical wall, an open bottom end, and an open top end. The fifth cylinder is sized to be received snugly by the top end aperture of the fourth cylinder.

A polymer clay skin 36 surrounds the cylindrical wall of the third cylinder 24 and covers the top end of the third cylinder. Polymer clay is a sculptable material comprising the polymer polyvinyl chloride (PVC) and one or more plasticizers to keep the clay soft until cured. Despite its name, polymer clay contains no clay minerals. While polymer clay is commercially available in many colors, a preferred embodiment of the present invention uses translucent polymer clay. The polymer clay skin is typically given an uneven surface texture to simulate the uneven surface of a hand-molded wax candle.

Figure 4:
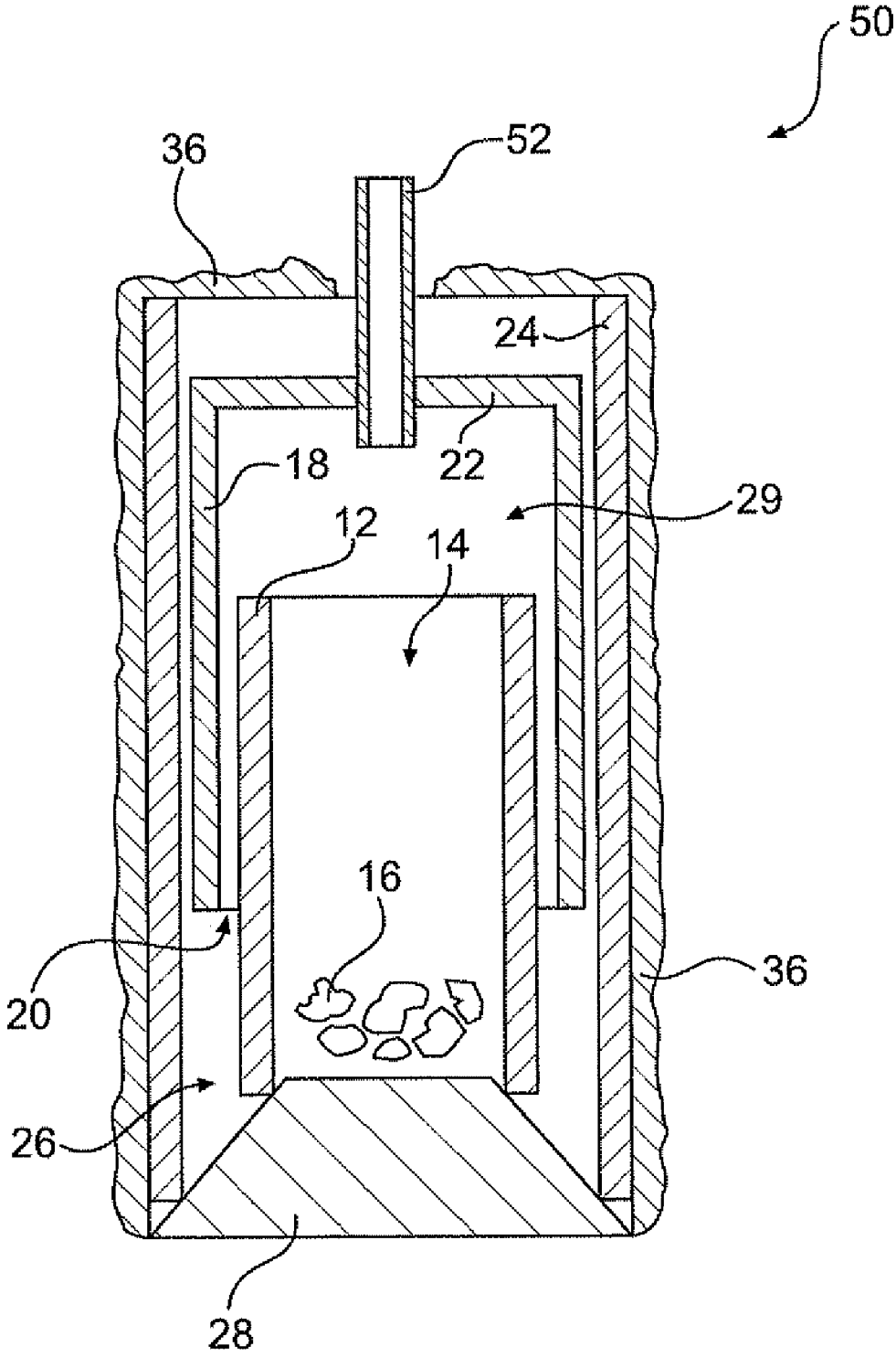
FIG. 4 is cross-sectional view of an artificial acetylene gas candle, in accordance with an alternative embodiment of the present invention.
Figure 5:
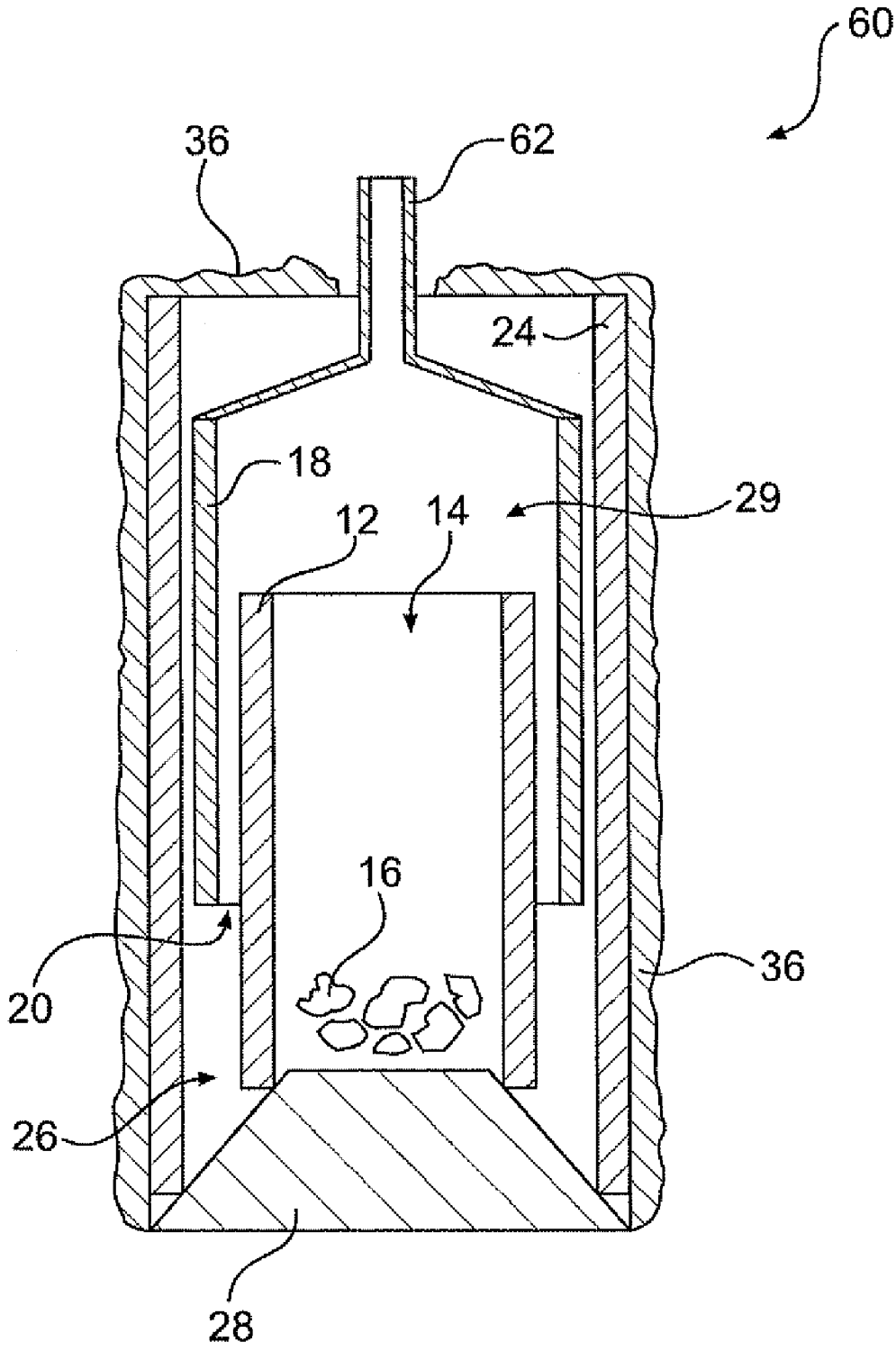
FIG. 5 is cross-sectional view of an artificial acetylene gas candle, in accordance with an alternative embodiment of the present invention.

The first, second, third, fourth, and fifth cylinders may be constructed of any suitable material. In one exemplary embodiment, all five cylinders are constructed of brass tubing having desired lengths and inner/outer diameters. The closed bottom end of the first cylinder may be formed, along with the closed bottom end of the third cylinder as shown in FIGS. 2, 4 and 5, using a relatively stiff rubber stopper 28 that is sized to fit snugly within the lower ends of both the first and third cylinders to form a watertight seal. Alternatively, the closed bottom end of the first cylinder may be formed using a brass end cap that is fastened, such as by soldering, to the cylindrical wall to form a watertight and gastight seal. The partially closed top end 22 of the second cylinder, which defines an aperture within the top end, may be constructed of a relatively stiff rubber stopper. The rubber stopper is sized such that it fits snugly within the upper end of the second cylinder to form a gastight seal. The aperture defined within the rubber stopper is sized to snugly receive the fourth cylinder to form a gastight seal. The closed bottom end of the third cylinder may be formed, along with the closed bottom end of the first cylinder as shown in FIGS. 2, 4 and 5 and as described above, using a relatively stiff rubber stopper 28 that is sized to fit snugly within the lower ends of both the first and third cylinders to form a watertight seal. Alternatively, the closed bottom end of the third cylinder may be formed using a brass end cap that is fastened, such as by soldering, to the cylindrical wall to form a watertight seal. The partially closed top end 32 of the fourth cylinder, which defines an aperture within the top end, may be constructed of a relatively stiff rubber stopper. The rubber stopper is sized such that it fits snugly within the upper end of the fourth cylinder to form a gastight seal. The aperture defined within the rubber stopper is sized to snugly receive the fifth cylinder to form a gastight seal.

As described above, that water is drawn by capillary action into the gap 20 between the first and second cylinders and into the fuel chamber 14 of the first cylinder when water in the water chamber 26 is at least as high as the gap 20. The water then contact the calcium carbide fuel and produces acetylene gas which begins to accumulate in chambers 14 and 29. As the acetylene gas continues to be produced, the pressure increases and the gas will exit chambers 14 and 29 via the fourth and fifth cylinders. The gas that is being emitted from the fifth cylinder is ignited to produce a bright flame. The flame will continue to burn as long as the acetylene gas is being produced at a sufficient volume to cause the necessary pressure increase. The acetylene gas will continue to be produced until either the calcium carbide fuel has been consumed or until the water level drops below the gap 20 such that water is no longer being drawn into the fuel chamber 14. The water substantially prevents the acetylene gas from escaping via gap 20. The snug fit of the second cylinder top end 22 and the fourth cylinder top end 32 substantially prevents the acetylene gas from escaping via any route other than the fourth and fifth cylinders.

Figure 3A:
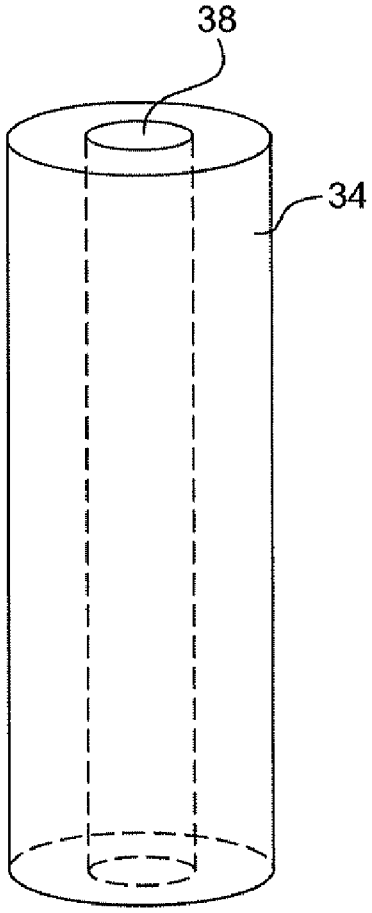
FIGS. 3A-3C illustrate the process of forming the "wick" of an artificial acetylene gas candle, in accordance with one embodiment of the present invention.
Figure 3B:
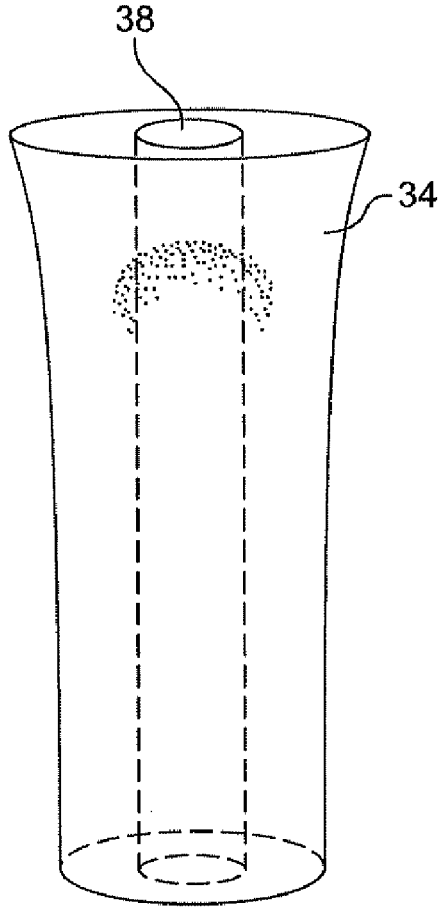
Figure 3C:
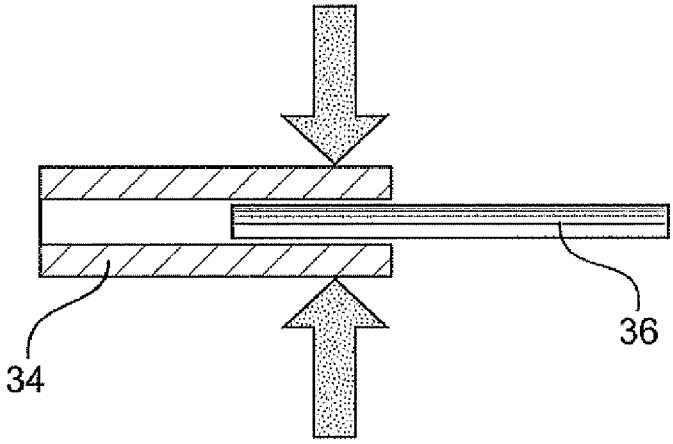

The fifth cylinder 34, from which the acetylene gas is emitted, is desired to resemble a wick of a wax candle. Thus, the fifth cylinder is typically sized to closely approximate the size of a wax candle wick. To enable the fifth cylinder to further resemble a wax candle wick, the upper portion of the fifth cylinder may be partially flattened or compressed toward the longitudinal axis of the fifth cylinder. This compression is purely esthetic, and the artificial candle will function with the fifth cylinder compressed or uncompressed. FIGS. 3A-3C illustrate the process of forming the "wick" of an artificial candle, in accordance with one embodiment of the present invention. FIG. 3A illustrates the fifth cylinder in an uncompressed state, and FIG. 3B illustrates the compressed state. As can be seen in FIG. 3B, the upper portion of the cylindrical wall is compressed while the lower portion remains uncompressed to ensure a snug fit of the lower portion within the aperture of the top end 32 of the fourth cylinder 30. Notably, the inner cavity 38 remains substantially uncompressed. It is important that compression of the inner cavity 38 be limited in order to not excessively impede flow of the acetylene gas through the fifth cylinder. One method of compressing the upper portion of the fifth cylinder while limiting compression of the inner cavity, illustrated in FIG. 3C, is to insert a solid wire into the upper portion of the inner cavity prior to compression. With the solid wire inserted, a compressive force is applied to the upper end of the fifth cylinder as illustrated by the arrows in FIG. 3C. This may be done by placing the fifth cylinder on a solid surface and striking the upper end with a hammer. The compressive force partially flattens the upper end, while the inserted solid wire limits compression of the inner cavity. The solid wire is then removed.

The solid wire is selected have a diameter slightly less than the inner diameter of the fifth cylinder to permit ready insertion and removal of the wire. The precise diameter of the solid wire may be selected to permit a desired amount of compression of the inner cavity (although the desired amount of compression must still permit ready flow of the acetylene gas). The difference in compression of the inner cavity affects the flow of acetylene gas which in turn affects the quality (e.g., color, brightness, size) of the resulting flame. For example, allowing very little compression of the inner cavity will typically result in a more yellow flame (which is considered to be a "warmer" flame color). Allowing slightly more compression will typically result in a whiter, brighter flame. Allowing yet again slightly more compression will typically result in a bigger, more yellow flame. The quality (e.g., color, brightness, size) of the flame can also similarly be controlled by the selection of the size (i.e., inner diameter) of the fifth cylinder.

It should be appreciated that the size and color of the flame is affected by the size of the smallest restriction through which the gas is emitted. In the embodiment of FIG. 2, the smallest restriction is formed by the fifth cylinder. However, if desired, the smallest restriction could be formed by some other portion of the structure.

Referring now to FIG. 4, a cross-sectional view of an artificial candle 50 is illustrated in accordance with an alternative embodiment of the present invention. In this alternative embodiment, the fifth cylinder of the artificial candle 10 of FIG. 2 is omitted. Instead, the fourth cylinder 52 is desired to resemble a wick, and the acetylene gas is emitted from the fourth cylinder 52. Thus, in this embodiment it is the fourth cylinder which is typically sized to closely approximate the size of a wax candle wick. This typically necessitates a smaller aperture in the top end 22 of the second cylinder. To enable the fourth cylinder to further resemble a wax candle wick, the upper portion of the fourth cylinder may be partially flattened or compressed toward the longitudinal axis of the fourth cylinder.

Referring now to FIG. 5, a cross-sectional view of an artificial candle 60 in accordance with another alternative embodiment of the present invention. In this alternative embodiment, the fourth and fifth cylinders of the artificial candle 10 of FIG. 2 are omitted. Instead, the second cylinder 18 has a top end 62 that is tapered upwardly and inwardly from the cylindrical wall. This tapered top end 62 is desired to resemble a wick, and the acetylene gas is emitted from the tapered top end. Thus, in this embodiment it is the tapered top end 62 which is typically sized to closely approximate the size of a wax candle wick. To enable the tapered top end 62 to further resemble a wax candle wick, the upper portion of the tapered top end 62 may be partially flattened or compressed toward the longitudinal axis of the second cylinder.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An artificial acetylene gas candle comprising:

a first cylinder comprising a cylindrical wall, a closed bottom end, and an open top end, the cylindrical wall and the closed bottom end forming a fuel chamber adapted to contain calcium carbide fuel;

a second cylinder comprising a cylindrical wall, an open bottom end, and a partially closed top end defining an aperture within the top end, the open bottom end adapted to slidingly engage the first cylinder, an inner diameter of the second cylinder sized relative to an outer diameter of the first cylinder such that water is drawn by capillary action into a gap between the first and second cylinders and into the first cylinder when the first and second cylinders are at least partially immersed in water;

a third cylinder comprising a cylindrical wall, a closed bottom end, and an open top end, the third cylinder adapted to receive water and to receive the slidingly-engaged first and second cylinders such that the first and second cylinders are at least partially immersed in water within the third cylinder;

a fourth cylinder comprising a cylindrical wall, an open bottom end, and a partially closed top end defining an aperture within the top end, the fourth cylinder sized to be received snugly by the second cylinder top end aperture; and a fifth cylinder comprising a cylindrical wall, an open bottom end, and an open top end, the fifth cylinder sized to be received snugly by the fourth cylinder top end aperture;

wherein water drawn into the first cylinder contacts the calcium carbide fuel resulting in formation of acetylene gas, and wherein the acetylene gas exits the artificial candle through the fourth and fifth cylinders to be ignited.

2. The artificial candle of claim 1, further comprising a polymer clay skin surrounding the cylindrical wall of the third cylinder.

3. The artificial candle of claim 2, wherein the polymer clay skin comprises a translucent polymer clay.

4. The artificial candle of claim 2, wherein the polymer clay skin has an uneven surface texture.

5. The artificial candle of claim 1, wherein opposite sides of an upper end of the fifth cylinder are partially compressed toward a longitudinal axis of the fifth cylinder.

6. An artificial acetylene gas candle comprising:

a first cylinder comprising a cylindrical wall, a closed bottom end, and an open top end, the cylindrical wall and the closed bottom end forming a fuel chamber adapted to contain calcium carbide fuel;

a second cylinder comprising a cylindrical wall, an open bottom end, and a partially closed top end defining an aperture within the top end, the open bottom end adapted to slidingly engage the first cylinder, an inner diameter of the second cylinder sized relative to an outer diameter of the first cylinder such that water is drawn by capillary action into a gap between the first and second cylinders and into the first cylinder when the first and second cylinders are at least partially immersed in water;

a third cylinder comprising a cylindrical wall, a closed bottom end, and an open top end, the third cylinder adapted to receive water and to receive the slidingly-engaged first and second cylinders such that the first and second cylinders are at least partially immersed in water within the third cylinder; and a fourth cylinder comprising a cylindrical wall, an open bottom end, and an open top end, the fourth cylinder sized to be received snugly by the second cylinder top end aperture;

wherein water drawn into the first cylinder contacts the calcium carbide fuel resulting in formation of acetylene gas, and wherein the acetylene gas exits the artificial candle through the fourth cylinder to be ignited.

7. The artificial candle of claim 6, further comprising a polymer clay skin surrounding the cylindrical wall of the third cylinder.

8. The artificial candle of claim 7, wherein the polymer clay skin comprises a translucent polymer clay.

9. The artificial candle of claim 7, wherein the polymer clay skin has an uneven surface texture.

10. The artificial candle of claim 7, wherein opposite sides of an upper end of the fourth cylinder are partially compressed toward a longitudinal axis of the fourth cylinder.

11. An artificial acetylene gas candle comprising:

a first cylinder comprising a cylindrical wall, a closed bottom end, and an open top end, the cylindrical wall and the closed bottom end forming a fuel chamber adapted to contain calcium carbide fuel;

a second cylinder comprising a cylindrical wall, an open bottom end, and a partially closed top end defining an aperture within the top end, the top end tapered upwardly and inwardly from the cylindrical wall, the open bottom end adapted to slidingly engage the first cylinder, an inner diameter of the second cylinder sized relative to an outer diameter of the first cylinder such that water is drawn by capillary action into a gap between the first and second cylinders and into the first cylinder when the first and second cylinders are at least partially immersed in water; and a third cylinder comprising a cylindrical wall, a closed bottom end, and an open top end, the third cylinder adapted to receive water and to receive the slidingly-engaged first and second cylinders such that the first and second cylinders are at least partially immersed in water within the third cylinder;

wherein water drawn into the first cylinder contacts the calcium carbide fuel resulting in formation of acetylene gas, and wherein the acetylene gas exits the artificial candle through the tapered top end of the second cylinder to be ignited.

12. The artificial candle of claim 11, further comprising a polymer clay skin surrounding the cylindrical wall of the third cylinder.

13. The artificial candle of claim 12, wherein the polymer clay skin comprises a translucent polymer clay.

14. The artificial candle of claim 12, wherein the polymer clay skin has an uneven surface texture.

15. The artificial candle of claim 11, wherein opposite sides of an upper end of the tapered top end of the second cylinder are partially compressed toward a longitudinal axis of the second cylinder.

* * * * *